US006971194B2

(12) United States Patent
McClelland et al.

(10) Patent No.: US 6,971,194 B2
(45) Date of Patent: Dec. 6, 2005

(54) MODULAR BACKHOE-EXCAVATOR CONTROL STATION

(75) Inventors: Katrina L. McClelland, Bowen, IL (US); Curtis R. Lyons, Burlington, IA (US); Larry A. Johnson, Burlington, IA (US); Dennis J. Heyne, Burlington, IA (US)

(73) Assignee: CNH America LLC, New Holland, PA (US)

( * ) Notice: Subject to any disclaimer, the term of this patent is extended or adjusted under 35 U.S.C. 154(b) by 0 days.

(21) Appl. No.: 10/602,748

(22) Filed: Jun. 24, 2003

(65) Prior Publication Data

US 2004/0261300 A1 Dec. 30, 2004

(51) Int. Cl.[7] ..... B60K 26/00; B60D 1/02; B60D 1/16; B60D 1/22

(52) U.S. Cl. ..... 37/347; 172/431; 180/322; 180/324; 180/326; 180/333; 180/334; 37/466

(58) Field of Search .. 37/348, 347, 466; 172/434–436, 172/431; 180/315–336, 78

(56) References Cited

U.S. PATENT DOCUMENTS

| | | | | |
|---|---|---|---|---|
| 4,140,200 | A | 2/1979 | Tucek | |
| 4,730,691 | A * | 3/1988 | Grigg | 180/329 |
| 5,794,730 | A * | 8/1998 | Kamen | 180/7.1 |
| H1831 | H * | 2/2000 | Kelley et al. | 180/333 |
| 6,250,844 | B1 * | 6/2001 | Sartler et al. | 404/112 |
| 6,352,133 | B1 * | 3/2002 | Ojima | 180/326 |
| 6,585,073 | B2 * | 7/2003 | Lorenz | 180/332 |
| 2004/0077464 | A1 * | 4/2004 | Feldman et al. | 482/57 |

FOREIGN PATENT DOCUMENTS

GB 2 351 796 A 1/2001

* cited by examiner

*Primary Examiner*—Christopher J. Novosad
(74) *Attorney, Agent, or Firm*—John William Stader; Stephen A. Bucchianeri

(57) ABSTRACT

A modular excavator-backhoe control station is disclosed, the station having two control towers with joystick on their upper ends that are pivotally coupled adjacent a floor of an excavator or backhoe. They have one piece polymeric boots that cover them as well as several additional operator controls. The towers are held in fore-and-aft position by a locking fluid cylinder that is adjustable to a many fore-and-aft positions. The towers also have upper portions that are laterally pivotal.

15 Claims, 4 Drawing Sheets

MODULAR BACKHOE-EXCAVATOR CONTROL STATION

FIELD OF THE INVENTION

The invention relates generally to backhoe and excavator controls. More particularly, it relates to control stations that include moveable structures that are repositionable with respect to the operator's seat.

BACKGROUND OF INVENTION

Backhoes and excavators are vehicles having a jointed arm with an implement at the end for engaging the ground and performing work. The operator swings the backhoe arm from side to side, lifts and lowers the boom, pivots the dipper with respect to the boom, and pivots the bucket (or other implement at the end of the dipper) in and out with respect to the dipper. In more complicated arrangements, the dipper is also extendable in and out to add to the length of the dipper and hence the reach of the backhoe arm itself.

All of these motions are performed repeatedly by the operator from an operator station located at the rear of the backhoe or excavator just above and a little behind the picot point of the arm itself. In traditional backhoes, the operator would operate six or eight separate levers, moving his hands form one to another and moving them forward and backward to cause and coordinate all of the motions described above. An operator's hands were constantly in motion, from lever to lever.

It is difficult for most operators to learn to operate all these controls with ease. To increase productivity and assist the operator other arrangements have been proposed that eliminate some levers and provide other levers that combine the functions of more than one lever.

Another problem with backhoe and excavator controls is their fixed position. For example, the controls in many if not most backhoes and excavators cannot be readily repositioned to suit operators of widely differing body types or to be moved to a variety of different operator operating positions.

As a result, operators are often required to position themselves with respect to the controls, often in quite awkward and uncomfortable positions. Positioning the controls too far toward the operator's seat may make it difficult or impossible to get out of the vehicle. Positioning the controls too far away from the operator seat will make entrance and exit from the seat easy, but may locate the controls too far away from the seat to be comfortable.

What is needed therefore is a system for controlling the position of the backhoe and excavator operator controls that is readily adjustable by the operator when entering and existing the seat. What is also needed is a control arrangement that does not require special tooling or lengthy periods of time to adjust. What is also needed is a control arrangement that permits the operator to adjust the position of the controls quickly and easily to provide a wide range of operating positions. It is an object of this invention to provide one or more of these benefits in one or more of the embodiments described below.

SUMMARY OF THE INVENTION

In accordance with a first embodiment of the invention, a control station for a backhoe implement is provided. The control station includes two control towers disposed on either side of an operator seat that extend up from the floor.

The towers pivot fore-and-aft and also laterally. They may include an adjustment mechanism that provides for a nearly infinite number of positions. This adjustment mechanism preferably includes a piston and cylinder arrangement that may include gas, liquid or a combination of both gas and liquid. The two towers may be coupled together to pivot together. They may include an arm or wrist rest disposed to support the operator's arm when the operator's hand manipulates controls at the top of the control towers. The control towers may be released to pivot by manipulating controls on the towers themselves. Rubber boots or covers may be provided to encase the towers and keep dirt out. The boots are preferably of a single piece tubular construction, surrounding the towers and extending from the uppermost portion of the towers to the floor of the operator's cab. The boots preferably have accordion-pleated portions that permit the boot to be flexed at one or more locations along its vertical length. These pleated portions preferably wrap around the towers. The towers are preferably coupled together by an elongate member that is fixed to the base of each tower and extends laterally from one tower to the other tower parallel to and adjacent to the floor of the vehicle. Both towers thereby pivot forward away from the operator or backward toward the operator at the same time.

BRIEF DESCRIPTION OF THE DRAWINGS

FIG. 2 also illustrates the elongate member that is fixed to and extends between each control tower thereby constraining the control towers to pivot fore-and-aft together.

DETAILED DESCRIPTION OF THE PREFERRED EMBODIMENTS

Figure 1:
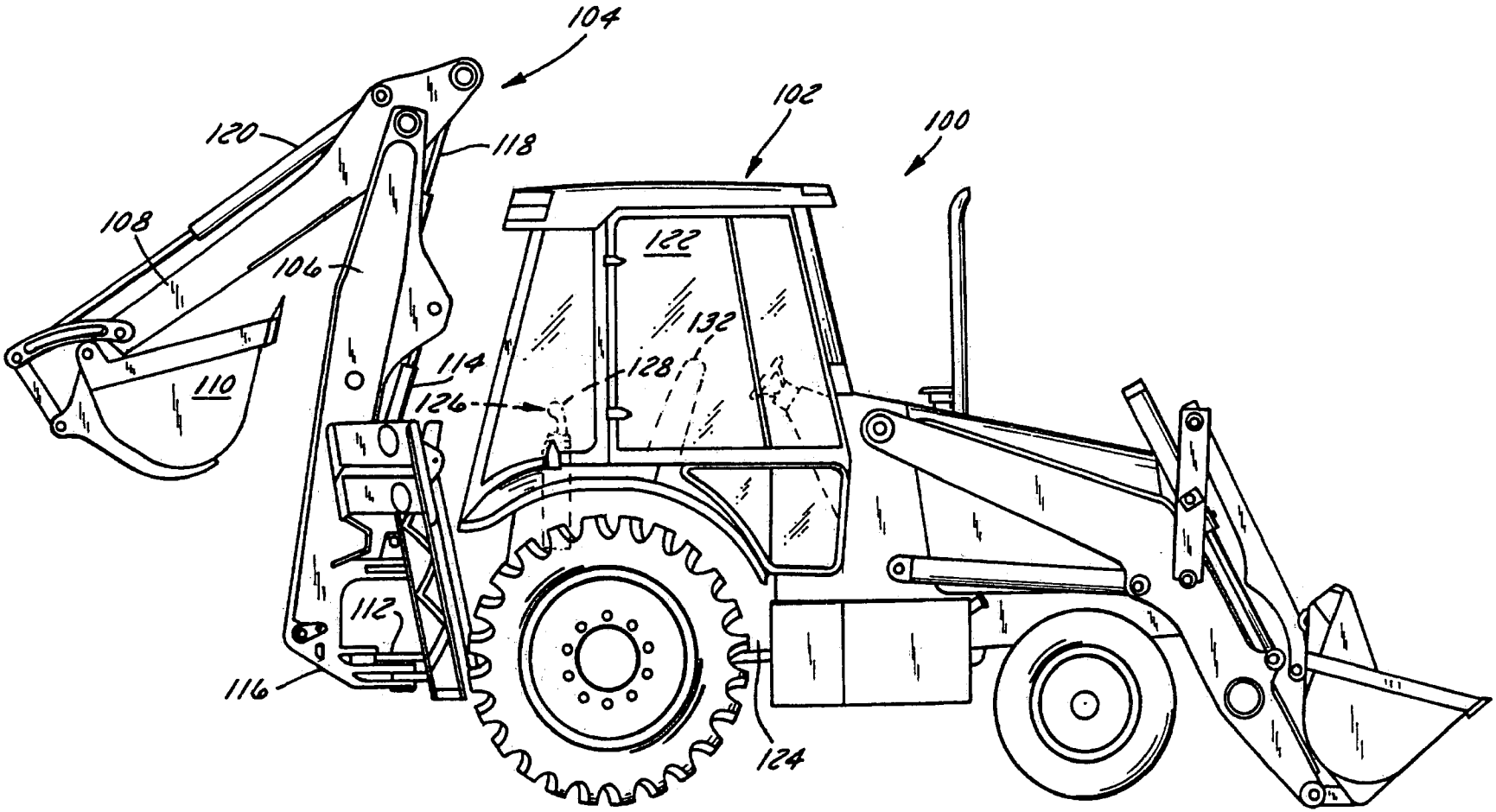
FIG. 1 is a side view of a loader-backhoe having a control station with two control towers in accordance with the present invention disposed inside an operator cab.

A backhoe 100 includes a tractor 102 coupled to a jointed backhoe arm 104. The backhoe arm 104 includes a boom 106 pivotally connected to a first end of dipper 108 and a bucket 110 pivotally connected to a second end of dipper 108. Hydraulic boom swing cylinders 112 are coupled to and between the boom base 116 and the chassis 124 of the tractor 102 and are extendable and retractable to pivot boom 106 about a generally vertical axis with respect to vehicle 102. Hydraulic boom lift cylinder 114 is coupled to and between the boom 106 and the boom base 116 and is extendable and retractable to pivot boom 106 about a generally horizontal axis with respect to boom base 116. Hydraulic dipper cylinder 118 is coupled to and between the dipper 108 and the boom 106 and is extendable and retractable to pivot dipper 108 about a generally horizontal axis with respect to the upper end of boom 106. Hydraulic bucket cylinder 120 is coupled to and between bucket 110 and dipper 108 and is extendable and retractable to pivot bucket 110 with respect to dipper 108.

The tractor 102 includes an operator compartment 122 that is mounted on chassis 124. It encloses an operator control station 126 having two towers 128, 130 (FIG. 3) and a seat 132.

In FIG. 1, the backhoe arm and the operator cab are attached to a tractor. The backhoe arm and the operator cab may also be attached to a tracked undercarriage, in which case the resulting vehicle is called an excavator. Both the tractor and the tracked undercarriage include an engine and provide support for the backhoe arm and the operator compartment to which they are coupled. Both configurations are deemed to fall within the scope of the claims unless the claims include specific limitations referring to either the tracked undercarriage or the tractor.

Figure 2:
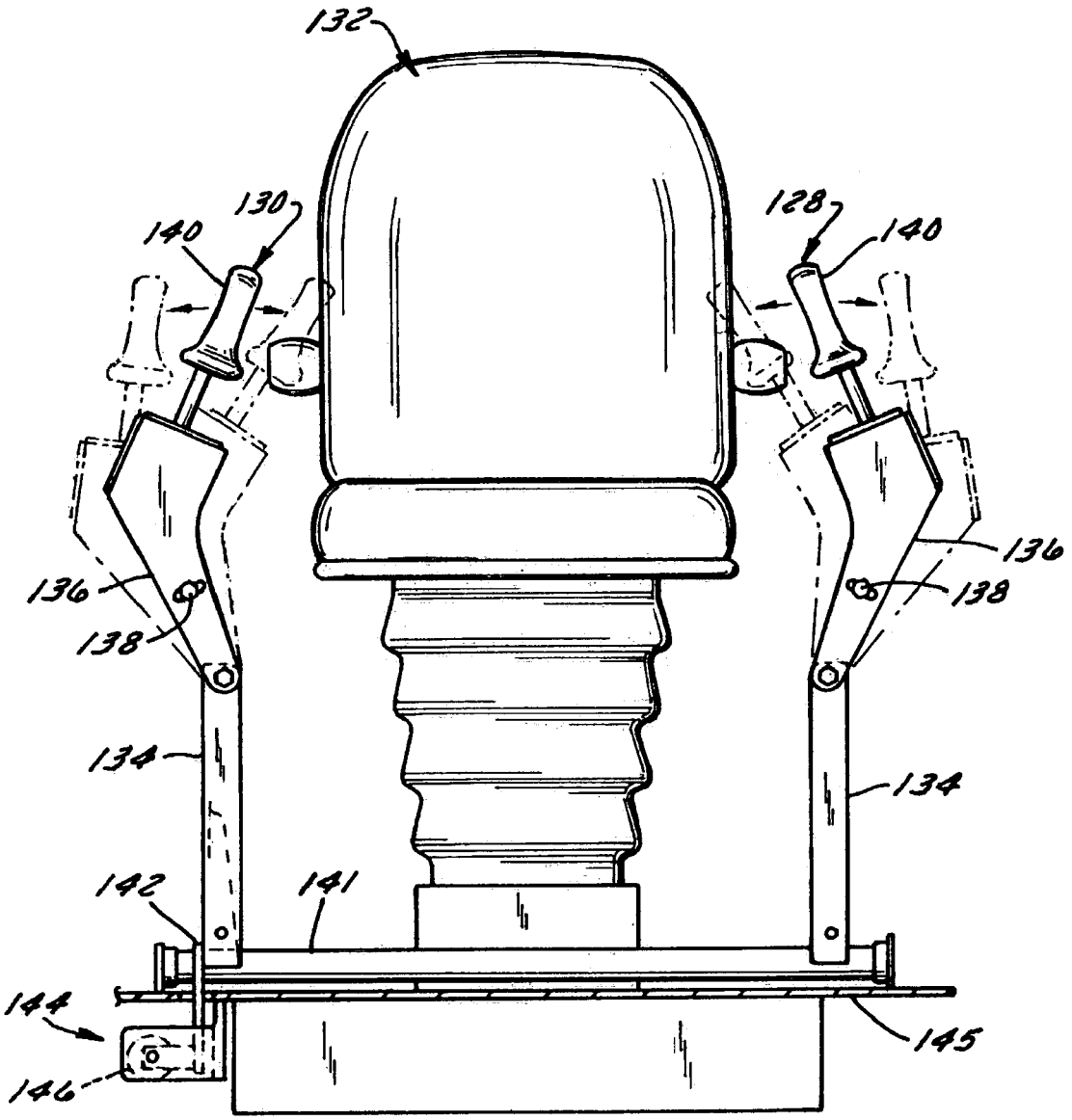
FIG. 2 is a front view of the control station of FIG. 1 illustrating the laterally pivotable upper portions of each control tower in an innermost and an outermost position.

Referring now to FIG. 2, seat 132 is disposed between left control tower 128 and right control tower 130 such that the controls on the control tower are manipulable when the operator is seated. As an aside, the terms "left", "right", "front", "rear", and "lateral" are used herein from the perspective of the operator when the operator's seat has been reversed and faces the backhoe arm. Thus, the operator's left hand (when sitting in the rear facing backhoe operator's position) is the backhoe tractor's right hand, and the "forward" direction to the operator is "rearward" to the backhoe tractor.

The control towers 128, 130 include lower portions 134 and upper portions 136 that are coupled to and pivotable with respect to the lower portions. The upper portions 136 pivot laterally inward toward the operator and laterally outward away from the operator to bring the controls closer to or farther away from the operator. The upper portions 136 have a virtually infinite range of adjustment with respect to the lower portions 134, provided by adjustment bolts 138 that fix the upper portion with respect to the lower portion. To adjust the upper portions, the bolts are loosened, the upper portions are pivoted inward or outward to the desired position, and the bolts are then tightened. This arrangement permits the upper portions of the control arms to be positioned with respect to the lower portions of the control arms in a virtually infinite number of positions. While it is most preferably to provide a wide range of relative locking positions, it preferably to provide at least five relative locking positions of the upper portions with respect to the lower portions, more preferable to provide at least ten, even more preferably to provide at least twenty, and even more preferable to provide at least fifty such relative locking positions.

Each control tower 128, 130 has a joystick control 140 disposed at an upper end of the tower extending upward from the tower and angled slightly inward toward the operator. Both joysticks are moveable in two directions: fore-and-aft and side-to-side. Movement in each direction commands a corresponding movement of the backhoe arm: boom swing left and boom swing right, boom lift and boom lower, dipper lift and dipper lower, and bucket curl inward and bucket dump. The claims of this application are not intended to be limited to any particular assignment of joystick movement directions to backhoe arm movement directions unless such limitations are included in the claims. The hydraulic and electrical interconnections between the joysticks and the hydraulic cylinders themselves are not illustrated or described here since they are known in the art.

Referring again the FIG. 2, lower portions 134 of the control towers are fixed to an elongate, laterally extending member 141 that is pivotally coupled to chassis of the vehicle at each end. In this manner lower portions 134 of both control towers are constrained to be pivoted fore-and-aft at the same time. This permits the simultaneous adjustment and positioning of both control towers.

A linkage 142 that is coupled to the control tower-elongate member assembly extends downward and away from the elongate member and is part of an adjuster assembly 144 that locks the control towers in fore-and-aft positions. The adjuster assembly is best viewed in FIG. 3.

In FIG. 2, elongate member 141 that couples the two control towers together and constrains them to pivot fore-and-aft together is disposed adjacent to the floor 145 of the operator compartment 122. Member 141 may include a single bar as shown or it may include a multi-bar linkage. It may be pivotally coupled to the vehicle floor, or it may pass through the vehicle floor and be pivotally coupled to the chassis of the vehicle. The specific location or structure to which it is coupled adjacent the floor of the vehicle should not be considered to limit the claims.

Figure 3:
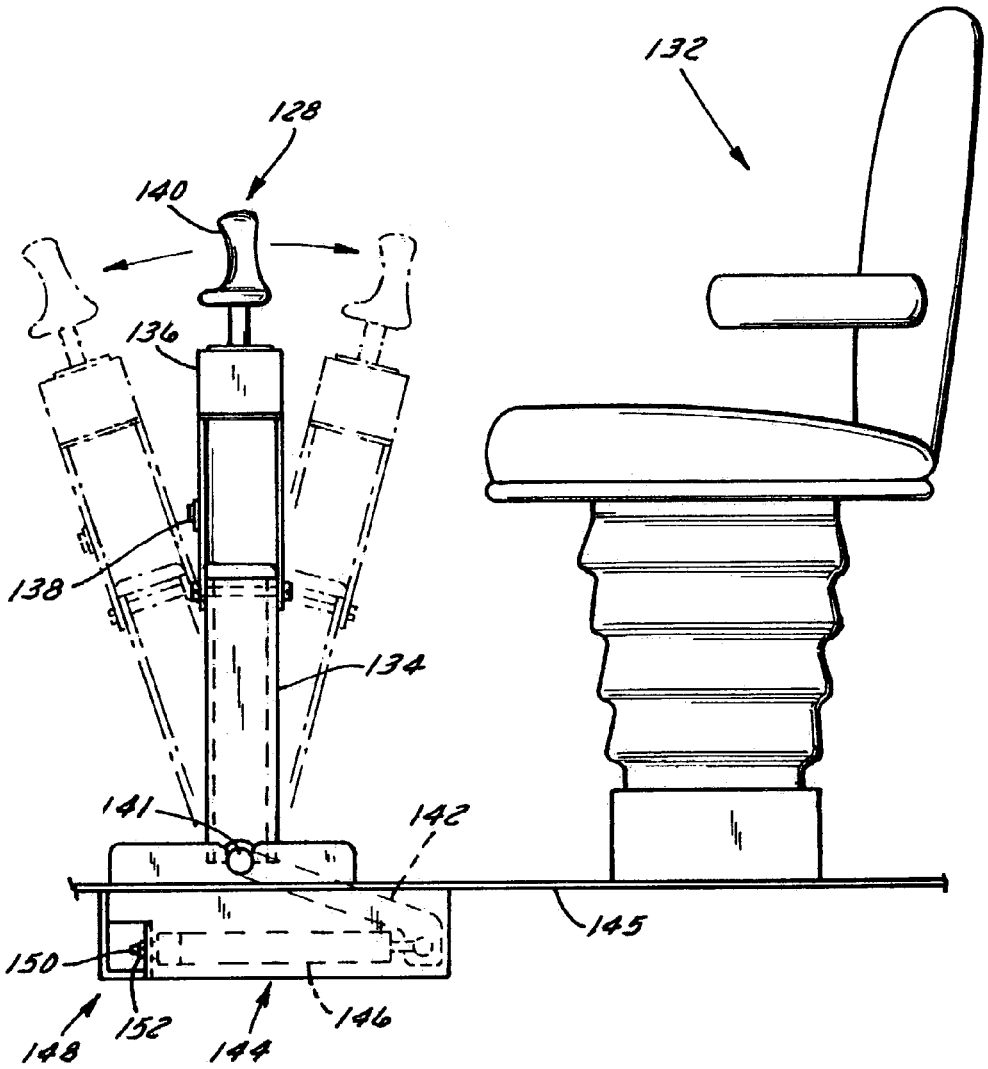
FIG. 3 is a side view of the control station of FIGS. 1–2 illustrating the fore-and-aft movement of the control towers and the adjustment mechanism that permits them to move forward and aft and permits them to be locked into virtually any fore-and-aft position.

FIG. 3 is a side view of the operator station showing the fore-and-aft movement of control towers 128, 130 and the adjuster assembly 144. Adjuster assembly 144 includes a fluid-filled locking cylinder 146 (preferably gas-charged) that is fixed with respect to the chassis 124 or floor 145 at one end 148 and is fixed to linkage 142 at the other end.

Cylinder 146 is adjustable in length by moving actuator rod 150 within piston rod 152 of cylinder 146. This movement opens a passageway through a hydraulic piston inside the cylinder that is connected to the rod. With this passageway open, hydraulic fluid can pass through the piston. This open passageway permits piston rod 152 to be moved further out of or further into the cylindrical portion of cylinder 146 thereby shortening or lengthening cylinder 146.

Whenever the control towers are pivoted fore-and-aft, the piston moves in the cylinder. Whenever the control towers are stationary, the piston does not move in the cylinder. Thus, by blocking flow through the piston and locking the piston in place, the control towers are also locked into place.

When actuator rod 150 is released, the passageway through the piston is blocked, and the piston and piston rod are locked in position within the cylinder portion of cylinder 146.

A preferred supplier of such locking gas springs or cylinders is Stabilus GmbH of Germany, a manufacturer of locking and non-locking gas springs manufactured under the trade names of BLOC-O-LIFT®, STAB-O-MAT® and STAB-O-BLOC®.

One advantage to locking gas springs is the fact that they provide a virtually infinite number of operating positions in which the control arms may be locked. The positioning material is a fluid inside a piston/cylinder arrangement, and the locking position depends upon how much fluid is permitted to leak through the piston. This arrangement permits the upper portions of the control arms to be positioned with respect to the lower portions of the control arms in a virtually infinite number of relative locked positions. While it is most preferably to provide a wide range of locking positions for the control towers with respect to the vehicle, and particularly with respect to the floor and the seat, it preferably to provide at least five such relative locking positions, more preferable to provide at least ten, even more preferable to provide at least twenty, and even more preferable to provide at least fifty such relative locking positions.

Cylinder 146 preferably includes a gas charge to assist the operator in moving the control towers. When cylinder 146 is unlocked or released the gas charge is coupled to the cylinder's piston to assist the operator in either moving the control tower forward and away from the operator, or moving the control towers back toward the operator. The direction of gas assist will depend, of course, on the particular configuration of the control towers. In some arrangements it may be more beneficial to assist by pushing the control towers away from the operator. In other arrangements it may be more beneficial to assist the operator in pulling the control towers toward the operator.

Figure 4:
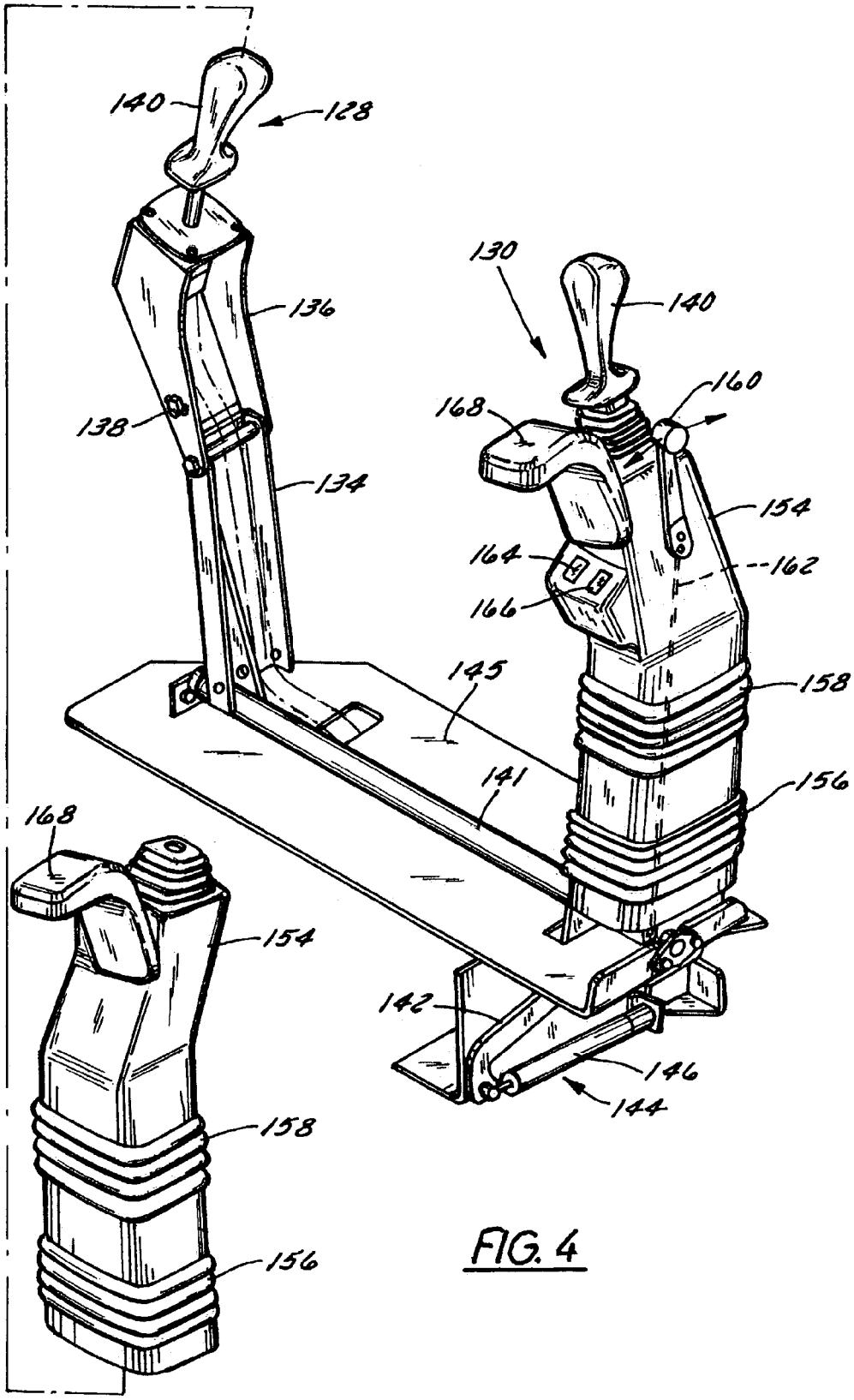
FIG. 4 is a perspective view of the control towers of the foregoing FIGURES illustrating flexible polymeric boots, additional controls, adjustment lever and wrist rests.

In FIG. 4 the control towers 128 and 130 are shown in perspective, illustrating the manner in which they are sheathed and the additional control devices located on them.

Each control tower has a flexible polymeric boot 154 that is in the form of a hollow tube having a generally rectangular cross section. Each boot 154 is constructed as a unit and is formed as a single piece and not in two or more vertically extending sections having a seam therebetween. The polymeric material is preferably an elastomer, such as an artificial, rubber or a rubber/plastic blend.

Each boot 154 includes two longitudinally extending flexible regions 156 and 158 that are accordion-pleated to permit the boots to flex. The lower of these region 156 is located adjacent to the floor of the operator compartment. It is positioned such that the bottom of the boot 154 located below region 156 can stay in contact with the floor 145.

The second flexible region 158 is positioned higher on the boot where the lower portion 134 of the control tower is pivotally coupled to the upper portion 136 of the control tower. When the operator loosens bolts 138 and repositions the top of one of the control towers, the upper flexible region 158 bends to accommodate this repositioning.

Right hand control tower 130 includes an operator input device 160 shown here as a lever, that extends from the upper portion 136 of the tower. Input device 160 is coupled to a linkage 162 that is operably connected to actuator rod 150 of cylinder 146. When the operator pivots lever 160 to a release position, the lever moves actuator rod 150 of cylinder 146 and releases the cylinder as described above. Once the cylinder is released, the operator can push or pull the control towers 128, 130 until they are pivoted into the preferred position. Once the control towers are in the desired position, the operator can return lever 160 to its original (locked) position. When returned to that position, actuator rod 150 is released, cylinder 146 locks up and the control towers are again fixed in position. Linkage 162 is preferably a cable, although it may be any combination of cables or members that couple actuator 150 to input device 160.

Several additional controls are conveniently disposed on the control towers 128, 130 as well. Control pattern master switch 164 is disposed on right hand control tower 130. This switch is configured the change the control pattern from a backhoe type pattern to an excavator type pattern, thereby accommodating operators familiar with both types of vehicle controls. The term "control pattern" refers to the relationship between joystick movement and the movement of the associated hydraulic cylinders.

Another control provided on control tower 130 is the master on/off switch 166. This switch disables joysticks 140. When they are disabled the joysticks no longer move the hydraulic cylinders when the joysticks are manipulated. The particular method by which this disablement occurs depends upon the type of joystick.

In practice, when preparing to operate the backhoe arm, the operator will release the control tower using lever 160, position the control towers, lock the control towers using lever 160, and then turn the master switch 166 "on", thereby enabling the joysticks 140. When leaving the vehicle or quitting work, the operator will perform the reverse steps of turning the master switch off, releasing the control towers and pivoting them forward and away from the operator.

Each of the control towers 128, 130 also includes a hand or wrist rest 168 that is coupled to the upper portion 136 of the control towers and extends backward from the control towers 128, 130 toward the operator seat 132. These wrist rests are configured to be loosened and slid up or down along the upper portion 136 of their associated control tower to position them in the proper vertical position. Once positioned, the fasteners that hold the wrist rests 168 to their respective control towers can be tightened and the wrist rests 168 locked in place. Wrist rests 168 will reduce operator fatigue and also permit the operator to more carefully move the joysticks thereby increasing the operator's accuracy of control.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown:

We claim:

1. A control station for a work vehicle, the work vehicle including an operator compartment, a chassis, a boom pivotally coupled to the chassis, a dipper pivotally coupled to the boom, an implement pivotally coupled to the dipper, at least one boom swing cylinder coupled to the boom to pivot the boom about a vertical axis, and a plurality of hydraulic cylinders including a boom lift hydraulic cylinder coupled to the boom to pivot the boom about a horizontal axis a dipper hydraulic cylinder coupled to the dipper to pivot the dipper about a vertical axis, and an implement hydraulic cylinder coupled to the implement to pivot the implement about a vertical axis, the control station comprising:

an operator seat;

a first control tower disposed adjacent to one side of the seat the first control tower having an upper and a lower end, the lower end pivotally coupled to the vehicle adjacent to the floor of the operator compartment to pivot generally fore-and-aft, the first control tower further comprising a first joystick operable to move at least two of the plurality of hydraulic cylinders;

a second control tower disposed adjacent an opposing side of the seat and having an upper and a lower end, the second tower having its lower end pivotally coupled to the vehicle adjacent the floor of the operator compartment to pivot generally fore-and-aft, the second control tower further comprising a second joystick operable to move at least two other of the hydraulic cylinders; and an elongate member coupled to and between the first and second control towers to constrain the towers to pivot fore-and-aft simultaneously, wherein each of the first and second control towers includes upper and lower members having upper and lower ends, the lower end of each of the upper members being pivotally coupled to the upper end of a corresponding one of the lower members.

2. The control station of claim 1, wherein the upper members are constrained by the lower members to pivot laterally inward toward the operator seat and laterally outward away from the operator seat.

3. The control station of claim 2, wherein the upper and lower members of each control tower are coupled together to lock together in at least five lockable positions.

4. The control station of claim 2, wherein the upper and lower members of each control tower are coupled together to lock together in at least twenty lockable positions.

5. The control station of claim 2, further comprising an operator input device to select between at least two control patterns and an operator input device to disable the first and second joysticks.

6. The control station of claim 1, further comprising an adjuster assembly configured to lock the control towers in at least five different fore-and-aft pivotal positions.

7. The control station of claim 1, further comprising an adjuster assembly configured to lock the control towers in at least twenty different fore-and-aft pivotal positions.

8. The control station of claim 1, further comprising a first unitary polymeric boot covering the first control tower and a second polymeric boot covering the second control tower.

9. A control station for a backhoe or excavator vehicle comprising:

an operator compartment including an operator seat;

a first control tower on the left side of the seat having an upper end with a first joystick extending therefrom, and a lower end pivotally coupled to the vehicle at the floor of the operator compartment, the first tower being constrained to pivot generally fore-and-aft;

a second control tower on the right side of the seat having an upper end with a second joystick extending therefrom, and a lower end pivotally coupled to the vehicle at the floor of the operator compartment, the second tower being constrained to pivot generally fore-and-aft;

each of the first and second control towers includes upper and lower members having upper and lower ends, the lower end of each of the upper members being pivotally coupled to the upper end of a corresponding one of the lower members, wherein the upper members are constrained by the lower members to pivot laterally inward toward the operator seat and laterally outward away from the operator seat;

a first unitary polymeric boot covering the first control tower and a second unitary polymeric boot covering the second control tower; and an adjuster assembly configured to lock the control towers in different fore-and-aft pivotal positions.

10. The control station of claim 9, wherein the adjuster assembly includes at least one locking fluid cylinder.

11. The control station of claim 10, wherein the locking fluid cylinder is a gas-charged spring configured to apply a pivoting force to the first and second control towers when the locking fluid cylinder is released.

12. An operator control station for an operator compartment of an excavator or backhoe vehicle, the operator compartment including an operator seat and a floor, the station comprising:

a pair of control towers that are mechanically fixed with respect to each other to pivot fore-and-aft together about a pivot axis, the axis extending laterally across the vehicle;

a pair of joysticks coupled to the top of the pair of control towers and configured to operate a jointed arm including a boom, a dipper and a bucket; and a pair of one-piece elastomeric boots surrounding the pair of control towers.

13. The station of claim 12, wherein the pair of control towers is disposed one on each side of the operator seat.

14. The station of claim 12, further comprising at least one locking fluid cylinder mechanically configured to lock at least one of the pair of control towers in at least twenty different locking positions.

15. The station of claim 14, wherein the at least one locking fluid cylinder is configured to lock the pair of control towers in at leas fifty different locking positions.

* * * * *